US006448722B1

(12) United States Patent
Yu et al.

(10) Patent No.: US 6,448,722 B1
(45) Date of Patent: Sep. 10, 2002

(54) PERMANENT MAGNET FOCUSED X-BAND PHOTOINJECTOR

(75) Inventors: David U. L. Yu, Rancho Palos Verdes; James Rosenzweig, Los Angeles, both of CA (US)

(73) Assignee: Duly Research Inc., Rancho Palos Verdes, CA (US)

( * ) Notice: Subject to any disclaimer, the term of this patent is extended or adjusted under 35 U.S.C. 154(b) by 0 days.

(21) Appl. No.: 09/538,347

(22) Filed: Mar. 29, 2000

(51) Int. Cl.[7] ..... H05H 9/00

(52) U.S. Cl. ..... 315/505; 315/500; 315/506; 315/5.41; 250/423 P; 250/492.24

(58) Field of Search ..... 315/505, 506, 315/500, 5.41; 250/423 P, 492.24

(56) References Cited

U.S. PATENT DOCUMENTS 5,336,972 A * 8/1994 Sheffield et al. ..... 315/5.41
6,332,017 B1 * 12/2001 Carroll et al. ..... 378/119

* cited by examiner

*Primary Examiner*—Bruce Anderson
*Assistant Examiner*—Nikita Wells
(74) *Attorney, Agent, or Firm*—Irving Keschner

(57) ABSTRACT

A compact high energy photoelectron injector integrates the photocathode directly into a multicell linear accelerator with no drift space between the injection and the linac. High electron beam brightness is achieved by accelerating a tightly focused electron beam in an integrated, multi-cell, X-band rf linear accelerator (linac). The photoelectron linac employs a Plane-Wave-Transformer (PWT) design which provides strong cell-to-cell coupling, easing manufacturing tolerances and costs.

11 Claims, 4 Drawing Sheets

PERMANENT MAGNET FOCUSED X-BAND PHOTOINJECTOR

GOVERNMENT RIGHTS IN INVENTION

This invention was made with Government support under Small Business Innovation Research (SBIR) Contract No. DE-FG03-98ER82566 awarded by the Department of Energy to DULY Research Inc. The Government has certain rights in the invention.

BACKGROUND OF THE INVENTION

1. Field of the Invention

A compact linear accelerator (linac) which produces high electron beam brightness by accelerating a tightly focused electron beam generated from a laser illuminated photocathode in an integrated, multi-cell, X-band rf linac.

2. Description of the Prior Art

Integrated photoelectron linear accelerators have been available in the prior art. For example, the inventors of the apparatus disclosed herein have previously developed a S-band integrated photoelectron linac focused by a set of compact solenoids to provide the necessary magnetic field for emittance compensation. The S-band linac employs a plane wave transformer (PWT) design which has advantages over conventional cup-and-washer linac design. The S-band integrated PWT photoelectron linac has been installed at a local university (UCLA) and utilizes a 20-MW, S-band klystron with a pulse length of 2.5 $\mu$sec and a repetition rate of 5 Hz as the rf power source, a Nd:YLF laser for the photocathode and a cooler/pressure control for the thermal/flow control of the PWT to produce a bright electron beam.

The PWT design of a linac structure was first referenced several decades ago by and was subsequently incorporated, though uncommonly, in several devices. For example, U.S. Pat. No. 5,014,014 to Swenson discloses a plane wave transformer linear accelerator for accelerating charged particles to high velocities and incorporates a tank section having end plates and iris-loaded washers supported by rods extending between the end plates. While the first Swenson linear accelerator built for UCLA never operated, a second PWT linac, again not integrated to the photocathode, built by UCLA did perform quite well. However, it has a serious disadvantage in that the linac is separated from the photocathode by a long drift section. As a result, the low-energy electron beam from the first short photoinjector gets a strong kick at the exit of the photoinjector and its emittance is degraded at the entrance to the drift tube. Complex external rf and magnetic subsystems are required in order to operate this photoelectron linac. In addition, this earlier UCLA PWT linac does not provide electrons of sufficient brightness for some commercial and high energy physics application. Although the new S-band integrated linac mentioned hereinabove does provide excellent results, many applications require a still brighter electron beam than can be produced thereby.

What is desired is to provide an integrated PWT photoelectron linac that provides an extremely bright electron beam required in research, industry and medicine.

SUMMARY OF THE PRESENT INVENTION

The invention provides a compact high energy X-band photoelectron injector which integrates the photocathode directly into a multi-cell linear accelerator with no drift space between the injector and the linac. By focusing the beam with permanent magnets, and producing high current with low emittance, extremely high brightness is achieved. In addition to providing a small footprint and improved beam quality in an integrated structure, the compact system simplifies external subsystems required to operate the photoelectron linac, including rf power transport, beam focusing, vacuum and cooling. The photoelectron linac employs a Plane-Wave-Transformer (PWT) design which provides strong cell-to-cell coupling, relaxes manufacturing tolerance and facilitates the attachment of external ports to the compact structure with minimal field interference. An enhanced brightness, X-band integrated photoinjector using a PWT and producing electron energy of tens of MeVs in a much smaller footprint, important for many commercial applications, is thus provided by the present invention.

The X-band PWT photoelectron linac of the present invention produces high-charge, relativistic electron bunches with subpicosecond duration. This, combined with high beam quality and extremely low emittance, will result in vastly increased beam brightness. A wide range of potential beneficiaries of a high-brightness electron beam includes future linear colliders, new-generation synchrotron radiation rings, and other electron beam based light sources such as free electron lasers (FEL) and Compton backscattering X-ray sources, as well as many applications further discussed below.

Compact, high-brightness, electron accelerators have many uses. They are widely used in nearly every field of physics from elementary particles to solid-state materials. They are also essential instruments in many fields of research for the study of structures in chemistry and biology, or for sensitive trace-element analysis. Compact linacs are useful in the fields of health, food preservation, energy, environmental monitoring and protection, and industrial processing. RF linacs can be used at low energies (several tens or hundreds of MeV) as injectors into synchrotrons and FELs or at high energies as particle colliders, accelerating electrons and positrons to hundreds or thousands of GeV. Accelerators have probably found their widest field of application in medicine, such as in tracer isotope production for nuclear medicine, or in X-rays, gamma, or charged particle production for diagnostics or therapy. In fact, compact rf electron linacs have been installed in over a thousand hospitals worldwide.

The present invention can be used with synchrotron radiation facilities as an injector into small emittance advanced storage rings, or to produce short wavelength coherent radiation using FEL interaction. In addition the proposed system can be used together with a terawatt, table-top laser to produce nearly monochromatic X-rays by Compton backscattering, of intensity comparable to that of second generation synchrotron radiation facilities, but at a lower cost and a smaller overall physical size.

DESCRIPTION OF THE DRAWING

For better understanding of the present invention as well as other objects and further features thereof, reference is made to the following description which is to be read in conjunction with the accompanying drawing therein.

DESCRIPTION OF THE INVENTION

A higher-frequency photoelectron linac enhances a beam brightness in a much smaller footprint, important for commercial as well as high energy physics applications. For a given energy gain, the physics of frequency scaling of photoinjectors is that longitudinal and transverse beam sizes, beam charge and the cavity dimensions scale inversely with the rf frequency, while the focusing field and the accelerating gradient scale linearly. Under these scaling rules, it is expected that the emittance will also scale inversely with the rf frequency, while the current is independent of frequency. Thus, for applications demanding very high brightness electron beams, high rf frequency photoinjector sources are desired. The design of a higher-frequency, smaller photoelectron linac, poses many practical challenges. In particular, several mechanical (cooling, support), materials (breakdown, dark current) and power (magnet, klystron) issues, which do not scale simply with frequency, require design innovations in order to realize a high-frequency, high-brightness, integrated photoelectron linac.

Figure 1:
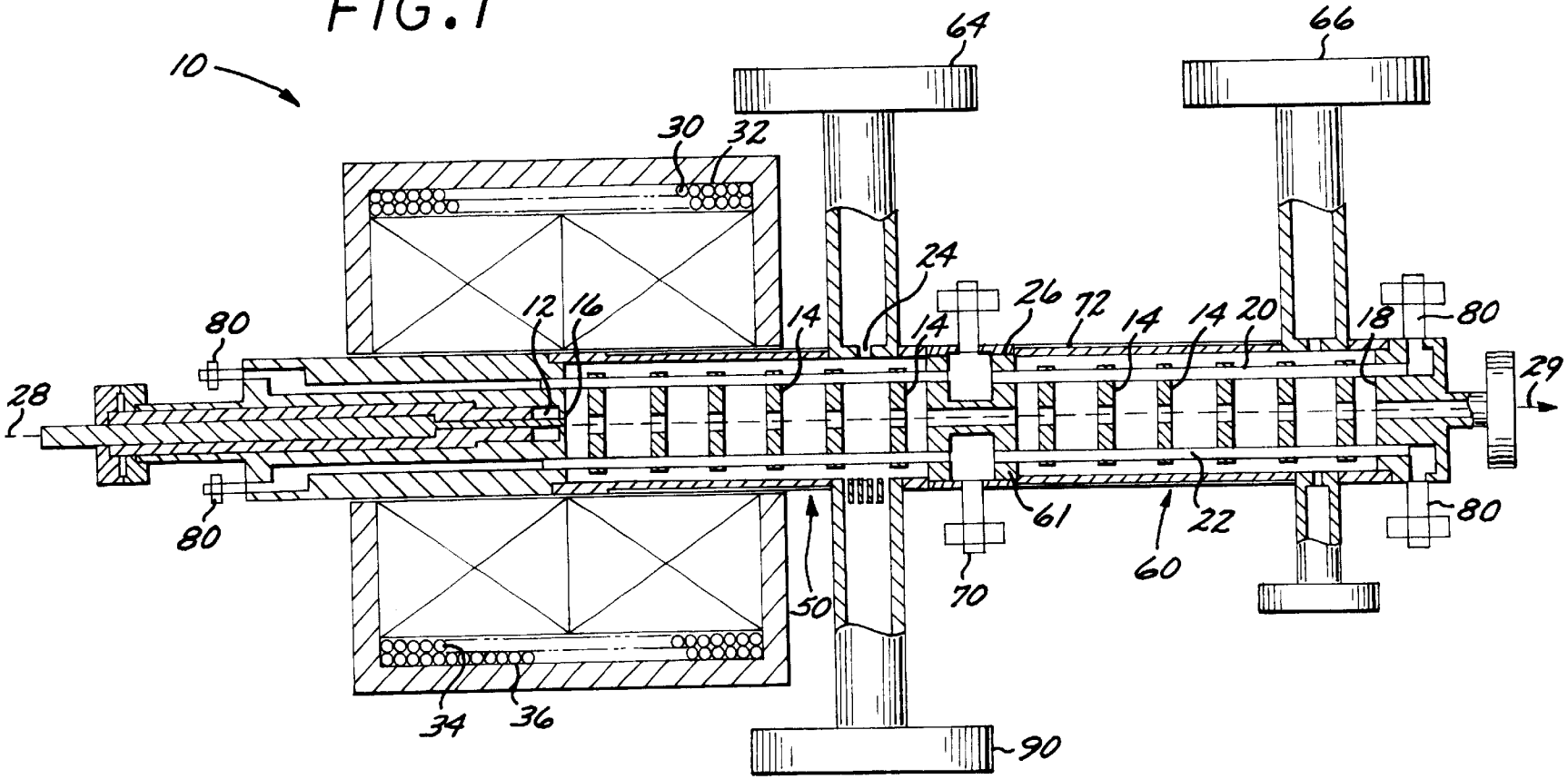
FIG. 1 is a schematic of the PWT photoelectron linac of the present invention.

FIG. 1 shows a schematic diagram of the X-band PWT photoelectron linac 10 of the present invention. A list of parameters characterizing the X-band PWT photoelectron linac 10 is shown in Table 1 (the term "photoinjector" as used herein denotes a short (1-½ cell) gun with a photocathode; the term "photoelectron linac" as used herein denotes an integrated accelerator in which the photoinjector is integrated into a long linac structure).

The integrated PWT photoelectron linac 10 of the present invention may be applicable to other operating frequencies than the X-band. The photocathode 12 is located directly inside the full accelerating structure, eliminating the long drift space between a short injector and the linac. This significantly improves the beam quality by mitigating the buildup of space charge effects. The PWT linac 10 is a π-mode, standing-wave, linac structure which consists of a series of cylindrical disks 14 spaced half a wavelength apart, except for the first and last disks which are at a distance about a quarter wavelength from the end plates 16 and 18. The disk assembly is supported by water-carrying tubes 20 and 22, serving both the functions of mechanical support and cooling of the disks 14. Suspended along the axis of a large cylindrical tank, the disk assembly defines a series of open cavities or cells. Unlike the conventional disk-loaded structure, the PWT cells have no cavity walls, thus providing strong cell-to-cell coupling. The rf power is coupled into the linac through a small hole 24 in the tank wall 26, the rf power exciting a TEM-like mode in the annular region between the tank wall and the disk assembly. This plane-wave electromagnetic field is coupled through the open cavities and transforms to a TM accelerating mode along the axis 28 of the disk irises. Electrons, produced by laser pulses incident upon the photocathode, are accelerated along the axis 28 of the disk assembly and emitted as beam 29. The laser beam is focused by an separate optical system external to the PWT and steered by a small mirror located in an optical chamber inside the vacuum envelope of the PWT linac (not shown).

A low-cost, high-brightness, X-band PWT photoinjector provides applications for advanced light sources. Compton backscattering X-ray sources, free-electron lasers and new-generation synchrotron radiation rings benefit directly from the bright electron source. The X-band PWT photoinjector is adaptable for use in high energy physics accelerators for which high luminosity is a premium. Using a high-brightness photoinjector to achieve low beam emittance, it is possible to ease linear collider damping ring design, or in the case of TESLA, to eliminate the damping ring with this device.

By scaling the prior art S-band PWT linac to a higher operating rf frequency, the integrated photoelectron linac will achieve much higher beam brightness, a key figure of merit for beam quality important for many applications. The concept of beam brightness is roughly related to the number of electrons in a "root-mean-square" volume occupied by a beam bunch. In a high-quality beam, a transversely small and longitudinally tight bunch containing a large number of electrons is capable of maintaining such properties after being accelerated to high energy. The beam brightness, by natural frequency scaling is:

$$B=2I/\epsilon^2 \propto Q/\sigma_z\epsilon^2 \propto \lambda_{rf},$$

where I is the beam current, or charge (Q) per bunch per unit time, $\epsilon$ is the emittance, $\sigma$ is the rms bunch length, and $\lambda_{rf}$ is the rf wavelength. It is clear from this expression that there is much to be gained by operating rf photoinjectors at a high frequency. In essence, the improved linac packs a large number of electrons in a small phase space volume. Beam brightness is optimally the highest at an X-band operating frequency. The expected beam brightness of the X-band electron source is $10^{15}$ A/m$^2$.

The prior art S-band PWT magnets consist of a main solenoid and a small bucking coil. However, scaling to an X-band PWT would require tripling or quadrupling the magnetic field, in a linac structure which is shorter by a factor of three or four. The sheer size of the resulting solenoidal focusing magnets would dwarf the X bank linac structure, making it extremely difficult, if not impossible, to provide space for rf, vacuum and diagnostic ports. A compact, high-field, magnetic focusing system is needed.

The present invention uses permanent magnets for primary focusing, and a small trim coil for fine adjustment. The hybrid, permanent-magnet focusing system has the advantages that 1) it is much more compact than the solenoidal focusing system, 2) it requires little, or no power to operate, 3) it is economical and easy to assemble. This system consists of two identical sets of permanent magnets 30 and 32 with opposite polarities. The main set of magnets straddles the front end of the PWT linac 10 beginning at the plane of the photocathode. An identical set of bucking magnets 34 and 36 extends beyond the linac over the cathode assembly. The combined magnets provide an exact cancellation of the field on the photocathode surface, and a maximum field which peaks at a distance about 1.5 cells from the cathode, as required by the emittance compensation scheme to focus the beam. A small trim coil (not shown) inside a common yoke of the main and bucking magnet assemblies provides the final adjustment of the focusing field on axis. The footprint of the magnetic focusing system overlaps only about one-quarter of length of the X-band PWT photoelectron linac, leaving ample space for all other subcomponents of the linac structure.

The PWT linac 10 is powered by an X-band kylstron, (not shown, is an examplar of an 8.657-GHz SL-3 klystron, capable of producing a 2-$\mu$s long pulse with 15 MW of peak power). Since the rf power reflected from the standing wave PWT structure during start-up and conditioning may damage the klystron, an efficient rf system is needed to distribute the available energy to the PWT linac and to prevent any reflected power from damaging the klystron.

Figure 2:
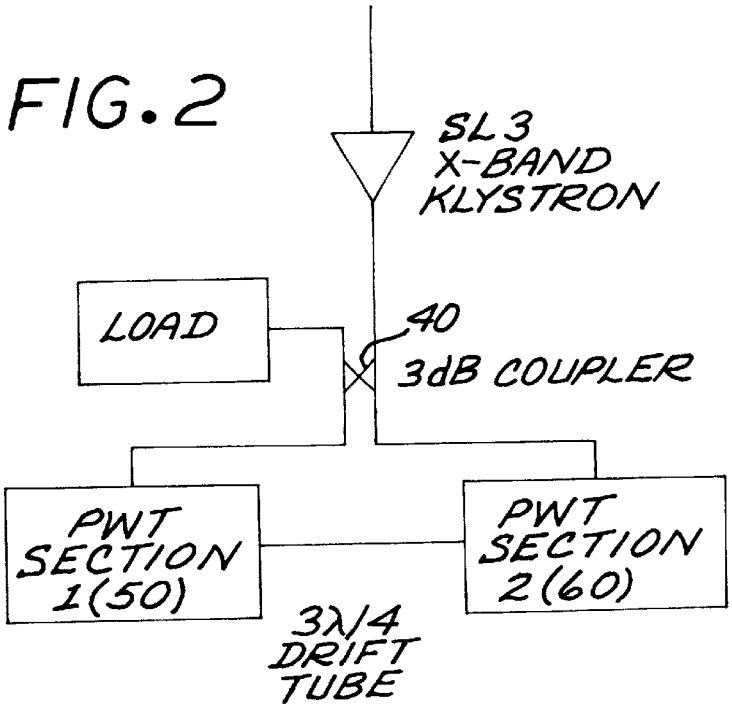
FIG. 2 is a schematic of the RF feed to the X-Band PWT.

Instead of using an expensive, high-power X-band isolator to absorb the reflected rf power, the present invention provides an alternative scheme to cancel the reflected power as shown in FIG. 2. A 30 dB coupler 40 is used to split the klystron power into two feeds to fill two sections of the PWT linac 10. There is a 90B phase difference between the two output feeds of the 3-dB coupler. RF reflections from the linac, via the two equal-length waveguides, resulting in a total of 180° phase difference between the two feeds will cancel at a load. A magic tee may also be used in place of the 3-dB coupler, in which case the path difference between the two feeds should be equal to a quarter guide length.

Figure 3:
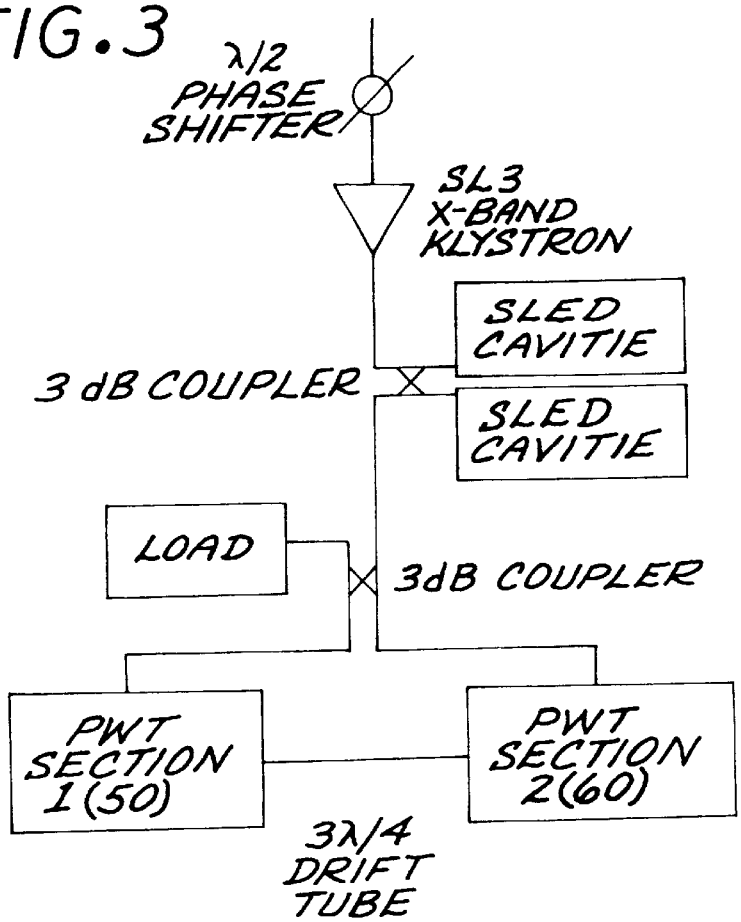
FIG. 3 is a schematic of the RF feed to the system of FIG. 2 with SLED.

Since the klystron pulse is long compared with the filling time of the linac structure, a SLED pulse compression system may be used to increase the peak rf power while shortening the pulse length. A SLED pulse compression system may be optionally installed between the klystron and the aforementioned 30 dB coupler or magic tee (see FIG. 3. The advantages of this rf system are twofold: 1) the SLED pulse compression increases the energy gain by 30%, and 2) by means of phase cancellation the 3-dB power splitter eliminates the need of an X-band isolator and prevents damage to the klystron due to the reflected power from the linac during startup and conditioning.

The X-band PWT accelerating structure must match the rf power system. Thus, the X-band linac 10 of the present invention preferably will be split into two sections 50 and 60, each powered by a separate rf feed through rf ports 64 and 66. The photocathode is integrated into the first PWT linac section 50 at the end plate 16 (see FIG. 1). The last cell of linac section 50 is connected to the first cell of linac section 60 by a small drift 61 tube having a length equal to an odd number of quarter wavelength, to compensate for the 90B phase difference between the two rf feeds. Each linac section is outfitted with an rf port 64 and 66. In addition to the electrical reasons of the split linac design, there are also mechanical advantages.

Because of rf heating and of the unique PWT linac design, adequate cooling and support of the X-band disk assembly are needed. These subsystems cannot be simply scaled from an earlier S-band prototype as the water tubes would be too small. The present invention solves this problem by allowing coolants to enter the two sections of the X-band PWT from the center divider water inlet 70 between the sections, and feed into four tubes in each of the two sections in parallel. The flow and temperature in the eight cooling tubes can be equalized easily by external adjustment at the tube exits. Water jackets 72 around the outer tank wall 26 provide further temperature control and frequency tuning of the PWT linac 10.

Figure 5:
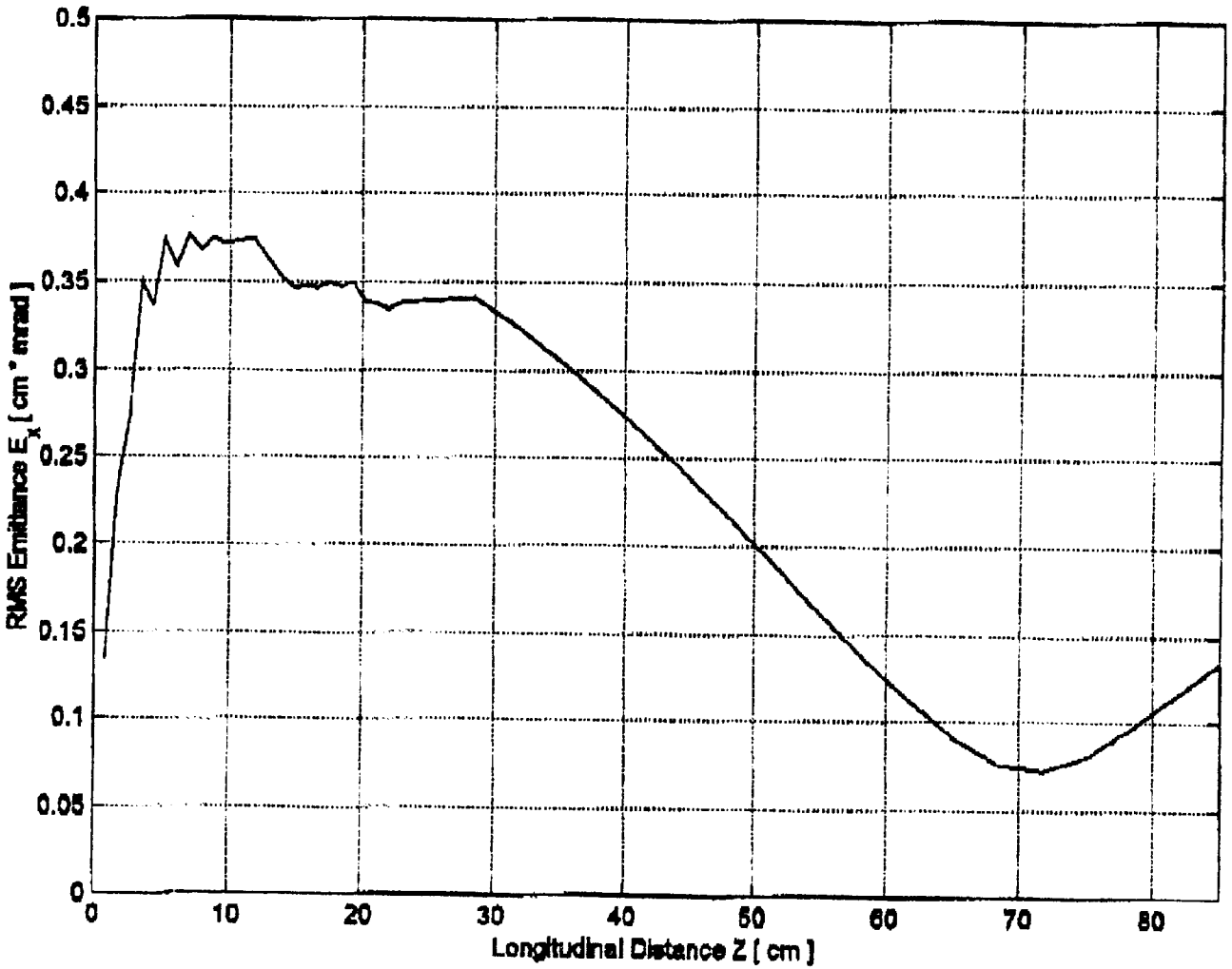
FIG. 5 illustrates the electron beam emittance along the beam axis for the X-band PWT.

A prescribed magnetic field profile, following the principle of emittance compensation is a key ingredient of success for the focusing and propagation of a small electron beam through the X-band PWT linac 10. The longitudinal magnetic field on axis must vanish at the photocathode, rise sharply to a maximum in the first full cell or thereabouts, and then taper down to zero within a few more cells. The radial and azimuthal components of the magnetic fields should be small. Such a magnetic field configuration assures that the beam emittance is compensated and preserved not only for the entire length of the accelerator, but also allows for the beam to be focused, beyond the PWT linac 10, to a spot sufficiently far away, where the first set of quadruple magnets are located (see FIG. 5). The required maximum focusing field, 4–5 kG, is determined from beam dynamics simulations.

Figure 4A:
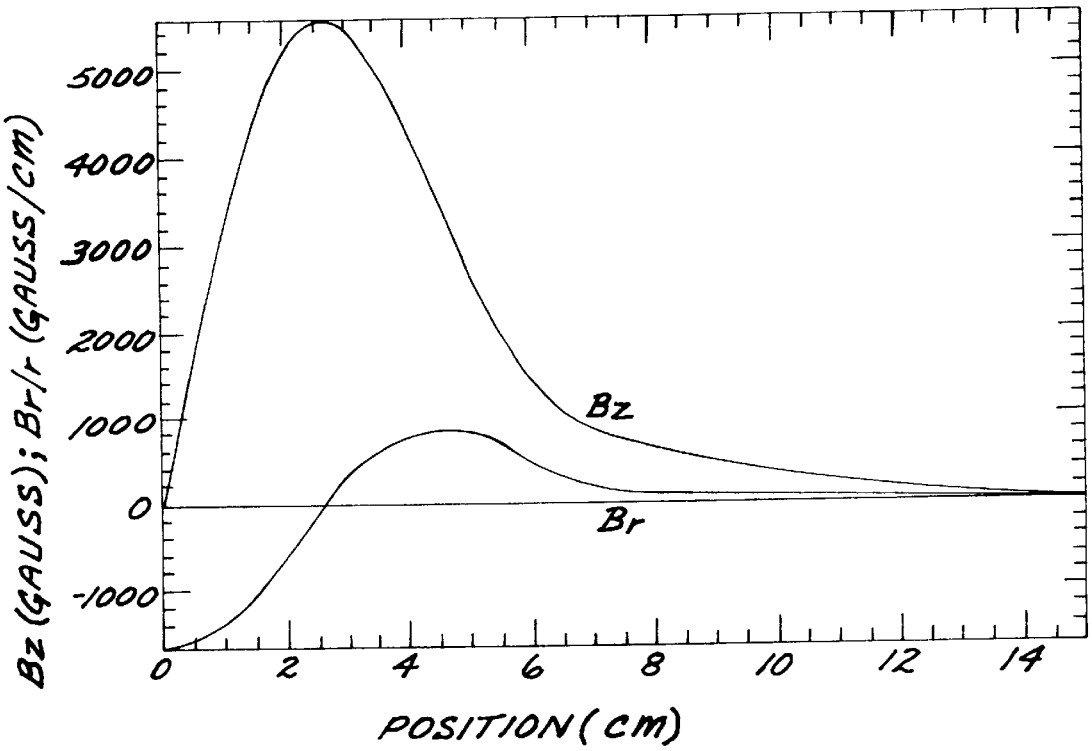
FIG. 4*a* illustrates the field lines produced by the permanent magnet utilized in the present invention.
Figure 4B:
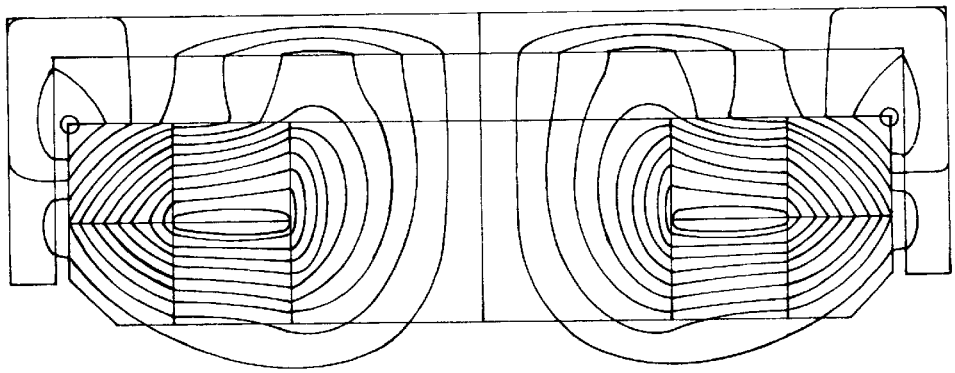
FIG. 4*b* illustrates the field strength of the permanent magnet shown in FIG. 4*a* along the length of the linac.

As noted hereinabove, using solenoids to obtain the necessary magnetic field profile for the X-band PWT would require large coils, leaving little room for other essential, auxiliary structures of the linac such as the rf, vacuum, cooling and laser ports. This is overcome by the present invention by using compact, permanent magnets in place of large solenoids, and to use a trim coil for final adjustment. FIG. 4*a* shows a permanent magnet design and the field lines produced by the permanent magnet and FIGS. 4*a* and 4*b* show the anticipated magnetic field profile. The main and bucking magnets are identical, but with opposite magnetization. A trim coil (not shown) may be included for final adjustment of the null position of the magnetic field at the cathode. For instance, a small current of 50 A (or 4000 ampere-turns) in an 80-turn, one-eighth-inch, square trim coil can move the position of the magnetic null (at cathode) axially by 1.4 mm. The footprint of this system, less than six inches in diameter, is quite small and fits well over the length of the PWT linac 10. The polarizations of the cylindrical magnets are achieved in practice by using a compartmentalized assembly of small magnets enclosed inside a non-magnetic yoke. Small changes in the positions of the small magnets can be made using passive and/or active shims with adjusting screws. The small footprint and low power requirement of the permanent-magnet focusing system will result in lower fabrication and maintenance costs than conventional solenoids.

In one embodiment of this invention, the main rf power supply for the X-band photoelectron linac is a 8.547 GHz, SL3 klystron producing square rf pulses at power levels in excess of 19 MW at 30 Hz repetition rate, with a pulse duration of 2 $\mu$s, and an amplitude ripple <2%. A traveling wave tube amplifier (TWTA) input drive to the klystron is synchronized to the laser oscillator, using a phase locked dielectric resonance oscillator (PDRO) to up convert the laser oscillator output frequency to the desired X-band drive frequency.

Because the SL3 klystron rf pulse is long (2 $\mu$s) compared with the filling time of the PWT linac, the klystron energy would be more efficiently utilized using an rf pulse compression system. The X-band PWT is a standing-wave accelerator, so the structure will be filled with energy. In one embodiment of the invention, the filling time constant at critical coupling is 292 ns. In 1 $\mu$s, the cavity voltage reaches 97% of its final value. Therefore, the last microsecond of the pulse is wasted. A compact SLED pulse compression system may be installed between the klystron and the aforementioned power splitter (see FIG. 3) as noted hereinabove. The SLED system stores some of the pulse energy, which would otherwise be wasted, and delivers it to the structure.

The design of two rf feeds naturally leads to a two-section accelerator design for the standing-wave PWT linac. To compensate for the phase difference between the feeds, the two linac sections are connected by a short drift tube having a length equal to an odd number of quarter-wavelengths. A drift tube length of $3\lambda/4$, about 2.6 cm long at 8.65 GHz, can be used. In this case, the rf phase of the second section is ahead of that of the first section by 90B.

The photocathode is inserted through a demountable flange to a center hole located directly in the end plate of the first linac section. The PWT linac structure consists of a series of suspended iris-loaded disks 14. The disks in each of the two linac sections are preferably supported and cooled separately by four water-carrying rods (only two illustrated). Two water inlets 70 (only one illustrated in FIG. 1) through the center divider, feed water in parallel into eight tubes, four in each section, (only two shown in each section) and the water outlets 80 are located outside the end plates at the far ends of the linac sections. No internal cooling channels inside the disks are needed.

Based on the available klystron power and the rf properties of the linac, the structural parameters, the expected accelerating gradient and energy gain for one rf/linac configuration is set forth in the following Table:

| | |
|---|---|
| Length of each section (cm) | 10.53 |
| Number of cells per section | 5 + 2 (½) |
| Filling time constant (ns) | 293 |
| Shunt impedance section (M) | 12.54 |
| Energy gain per section (MeV) | 9.70 |
| Total energy gain (MeV) | 19.40 |
| Active accelerator length (cm) | 21.06 |
| Accelerating gradient (MV/m) | 92.10 |

In the preferred embodiment, the X-band PWT linac is separated into two sections as shown in FIG. 1. Each section in the baseline design is a 5+2/2 cell, $\pi$-mode accelerating structure. The cells are divided by a series of six cylindrical copper disks spaced one-half wavelength apart, with a ½ cell on each end. There is a $3\lambda/4$ drift between the two sections. Besides the issues of the reflection of rf power back to the klystron during the startup and conditioning phases, the design with two sections has other advantages over the prior art line accelerator. The shorter length lessens the material strength requirement of the support rods and it shortens the distance that the cooling water must travel, reducing cooling water head loss due to friction in the pipes. Additionally, the separation into two sections reduces the heat load on the cooling system, and it is easier to hold high tolerance when the accelerating structure is brazed together because the structure itself is smaller.

Dividing the accelerating structure into two sections matches the scheme of two rf feeds to solve the problem of isolating the klystron from the referenced rf power. The simplest way is to drive the two separate sections of the linac with a relative phase difference of $\pi/2$. Since the sections are not driven at the same phase, there must be a drift section between the two accelerating sections. This drift section allows time for the rf in the second section to "catch up" and become synchronized with the phase that the electron bunch experienced in the first section. If the second section lags the first section by $\pi/2$, then the length of the drift section is $\lambda/4$ long to provide the rf the quarter period required to match phase. If the second section leads the first section, then a section $3\lambda/4$ long is required. In terms of matching the rf phase, either choice is acceptable, but the design of the cooling and the positioning of the mirror used to reflect the laser beam at the photo cathode would benefit from the extra room created by a longer drift tube. Also, a longer drift section will decrease the rf coupling between the two accelerating sections.

The design of the X-band PWT shown in FIG. 1 does not use simply scaled support/cooling tubes, but rather, the design incorporates standard tubing sizes which are commercially available at low cost of production. This increase in relative tubing size, combined with all the above design changes, results in an overall decrease in the center deflection of the X-band structure over the s-band structure by a factor greater than 150. This extremely large gain in the relative strength of the support apparatus for X-band PWT allows the use of other materials to replace the stainless steel cooling/support tubes, such as synthetic diamonds.

The baseline design for the disk cooling has temperature-controlled water flowing in the 8 support/cooling tubes. The cooling to the disk is provided by conduction through the wall of the support/cooling rods, significantly decreasing the cost and time associated with the machining and brazing of the copper disks with a channel for water-cooling. The design of FIG. 1 takes advantage of the drift section to eliminate the requirement that the cooling water run the length of the machine. The drift section will be used as an inlet reservoir for the cooling water. The water is carried away from the inlet reservoir by 8 cooling tubes, with 4 tubes feeding each of the two PWT linac sections. The respective end plates are also designed to act as outlet reservoirs. Thus, the cooling water is fed into the center of the PWT and flows longitudinally toward each end plate. Each of the two water inlets 70 will feed two of four cooling tubes that run to each of the sections, and each end plate also has two outlets 80 that combine the flow from two tubes. Thus, there are two water inlets and a total of 4 water outlets (two on each end plate). The active cooling of each section of the PWT can be monitored by observing flow rate and temperature at each outlet.

The outside tank of the PWT structure is surrounded by a water filled cooling jacket 72. This outer jacket 72 is supplied by a separate temperature-controlled water source from the main disk cooling. In addition to removing excess heat deposited on the outside wall by the rf, varying the temperature of the tank allows a fine frequency tuning of the accelerating structure. Separate tuning of each end of the PWT linac is possible by separating the jacket into two sections, each of which, roughly overlaps the disk assembly sections. Each of these sections can be fed from the center and the flow to each section can be controlled at the outlets, if such control is desired.

The vacuum in the accelerator region is provided via a pumping port 90 that is brazed of the tank wall near the end of the first linac section. RF integrity at the tank wall is maintained by using a vacuum sieve at the braze joint. The sieve is constructed by drilling numerous small holes in a piece of copper that is machined to match the inner diameter of the tank wall. This copper piece is then brazed to the main port flange. The size of the holes is small enough that it does not significantly interfere with the rf.

The electrons are created by the interaction of a short-pulse, high-fluence, UV laser and the photocathode rod. The photocathode assembly is removable from the vacuum system for surface cleaning and replacement. The cathode is inserted into a guiding sleeve until the machined tip of the cathode comes into contact with an indicating surface. This surface controls the axial position of the photocathode so that the tip is flush with the entrance to the accelerating chamber, where the magnetic field is zero. The radial positioning is controlled by the guiding sleeve. The sleeve provides radial alignment of the photocathode by locking into guide slots machined into the end plate that is brazed to the tank assembly of the PWT and when inserted, holds the watch-band spring rf seal in place near the tip of the photocathode.

The photoinjector laser system is designed to deliver sufficient laser energy to produce over 1 nC of charge on the photocathode within 3 degrees of X-band rf phase at a repetition rate of 10 Hz. The laser system is based on chirped pulse amplification (CPA) and consists of six major component: an ultrashort pulse oscillator (including the oscillator pump laser), a pulse stretcher, an electrooptic switch, an amplifier (including Lo- the amplifier pump laser), a pulse compressor, and frequency conversion crystals. The laser pulse need not be fully compressed to obtain a nominal value for high charge: a 1 $\mu$s square optical pulse is adequate. Because the laser starts with a very short pulse (<15 fs), it is possible to do temporal shaping with a mask at the Fourier plane of the CPA system, and produce square optical pulses with a fast rise and fall. The total energy should be sufficient to produce bunches with up to a few nC of charge. Shorter pulses can be formed by further compression.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A compact, radio-frequency driven, plane wave transformer linear accelerator having a longitudinal axis for accelerating a beam of charged particles produced by a cathode assembly comprising:

a plurality of cylindrical disks suspended by a plurality of rods and positioned inside a cylindrical tank, which is capped at both ends with an end plate;

means for applying high-frequency rf power to said tank and converting the rf power in the X-band frequency range initially to a coaxial electric field in the region between the outer layers of said cylindrical disks and the inner wall of said cylindrical tank and then transformed to an electric field along the longitudinal axis of the said disks, said rf power being in the high radio frequency range in order to maximize the brightness of said particle beam; and a magnet focusing system positioned in operative relationship to said accelerator for focusing the charged particle beam.

2. The linear accelerator of claim 1 wherein a photocathode is positioned at the center of the first end plate; said charged particles being generated from said by heating.

3. The linear accelerator of claim 2 wherein said photocathode is demountable from said first end plate.

4. The linear accelerator of claim 2 wherein said magnetic focusing system further comprises hybrid permanent magnets and small trim; the coils, said permanent magnets generating a large axial magnetic field required for beam focusing, and said trim coils in conjunction with said permanent magnets providing a magnetic field null on the surface of said photocathode.

5. The linear accelerator of claim 2, wherein said rf power is first split equally by means of a 3 dB coupler or a magic tee, the split rf power then being fed by means of first and a second waveguides to two separate sections of said accelerator, each section having a plurality of cylindrical disks positioned therein, the relative lengths of said first and second waveguides being adjusted in order to provide cancellation of the reflection of said rf power from said two accelerator sections at said 3 dB coupler or magic tee.

6. The linear accelerator of claim 5 wherein said first and second accelerator sections are joined by a short drift tube to provide phase compensation of the particle beam in relation to the rf phases in the first and second accelerator sections, said drift tube being enclosed in a metallic block located midway of said linear accelerator.

7. The linear accelerator of claim 5 further including cooling means coupled to said first and second accelerator sections, each of said section cooling means comprising;

a water jacket outside said cylindrical tank, and a set of water tubes comprising said rods connecting said cylindrical disks.

8. The linear accelerator of claim 7 wherein the main water inlets and outlets of the said water jackets are located outside the water jackets; the main water inlets of the said water tubes being housed in and extended from said metallic block midway in said linear accelerator, and the outlets of said water tubes are housed in and extended from said respective end plates of said linear accelerator.

9. The linear accelerator of claim 1 wherein a cathode is positioned at the center of the first end plate, said charged particles being generated from said cathode by heating.

10. The linear accelerator of claim 9 wherein said cathode is demountable from said first end plate.

11. The linear accelerator of claim 9 wherein said magnetic focusing system comprises hybrid permanent magnets and trim coils, said permanent magnets generating an axial magnetic field required for beam focusing, said trim coils in conjunction with said permanent magnets providing a magnetic field null on the surface of said cathode.

* * * * *